United States Patent [19]

Bengeult

[11] Patent Number: 4,730,172

[45] Date of Patent: Mar. 8, 1988

[54] LAUNCHER FOR SURFACE WAVE TRANSMISSION LINES

[75] Inventor: Greg A. Bengeult, Auburn, Wash.

[73] Assignee: The Boeing Company, Seattle, Wash.

[21] Appl. No.: 913,774

[22] Filed: Sep. 30, 1986

[51] Int. Cl.[4] ..... H01P 5/10; H01P 3/10

[52] U.S. Cl. ..... 333/26; 333/34; 333/240

[58] Field of Search ..... 333/34, 240, 26

[56] References Cited

U.S. PATENT DOCUMENTS

| | | | |
|---|---|---|---|
| 2,497,706 | 2/1950 | Wetherill | 333/34 |
| 2,737,632 | 3/1956 | Grieg | 333/34 X |
| 2,852,753 | 9/1958 | Gent et al. | 333/240 X |
| 2,938,179 | 5/1960 | Unger | 333/34 |
| 3,320,556 | 5/1967 | Schneider | 333/34 |
| 3,323,082 | 5/1967 | Kenneally | 333/34 |

*Primary Examiner*—Paul Gensler

*Attorney, Agent, or Firm*—Christensen, O'Connor, Johnson & Kindness

[57] ABSTRACT

Disclosed is a surface signal launcher for coupling RF signals between a coaxial cable in a single-wire surface wave transmission line. The signal launcher includes a shell-like, electrically conductive launcher horn that is installed at the juncture of the coaxial cable and the surface wave transmission line with the launcher horn concentrically surrunding the portion of the surface wave transmission line that is immediately adjacent the coaxial cable. The coaxial cable outer conductor is electrically connected to the forward end of the launcher horn with the center conductor of the coaxial cable being connected to one end of the surface wave transmission line. To prevent signal reflection at the interface between the coaxial cable and the launcher horn, the diameter of the launcher horn forward end is established to provide an impedance that is equal to the characteristic impedance of the coaxial cable. Aft of the forward end, the diameter of the launcher horn smoothly increases as a function of axial distance in a manner that establishes an impedance/axial distance relationship that corresponds to a Chebyshev impedance taper.

6 Claims, 6 Drawing Figures

LAUNCHER FOR SURFACE WAVE TRANSMISSION LINES

BACKGROUND OF THE INVENTION

This invention relates to the launching and receiving of electromagnetic waves that are guided by and travel along a single conductor. More specifically, this invention relates to surface wave launchers of the type that form a transition between a coaxial cable and a surface wave transmission line.

As is known in the art, broadband, low-loss transmission of RF electromagnetic energy can be achieved through the use of a single conductor that is configured or treated to concentrate and confine the electromagnetic energy to a cylindrical volume that coaxially surrounds the conductor. This type of transmission line is known as a surface wave transmission line, a Goubau line, or G-line. In the more commonly known surface wave transmission lines, a conductor is surrounded by a coating of low-loss, dielectric. Since the phase velocity of electromagnetic energy that propagates through the layer of dielectric material is less than the free-space phase velocity, at least the majority of the electromagnetic energy is confined to the dielectric and a cylindrical volume of space that concentrically surrounds the dielectric coating. Other techniques for suitably decreasing the phase velocity of the transmitted signal also are known. For example, crimping an uncoated wire or machining threadlike grooves in the wire surface will cause a reduction in the phase velocity of signals traveling along the wire, thereby causing the uncoated wire to act as a surface wave transmission line.

In most systems that utilize surface wave transmission lines, the lines are utilized in combination with more conventional signal transmission structure such as coaxial cable and/or waveguide. In this regard, conventional equipment for generating and receiving signals is adapted for use with more conventional transmission structure such as coaxial cable or waveguide. Thus, transitions are required to couple signals between a surface wave transmission line and other transmission structure. Further, in many situations, use of only a surface wave transmission line is impractical. Specifically, bends and other discontinuities in a surface wave transmission line cause radiation of a portion of the electromagnetic energy traveling along the line, thereby resulting in transmission losses.

Systems in which the electromagnetic wave is coupled between a surface wave transmission line and a coaxial cable most often employ a horn-like surface wave "launcher" for forming the transition between the coaxial cable and the surface wave transmission line. In such a launcher, the surface wave transmission line forms an axial extension of the center conductor of the coaxial cable and a relatively thin-walled conductive horn in effect forms an outwardly flared extension of the outer conductor of the cable. That is, the smaller end of the horn, which is electrically connected to the outer conductor of the coaxial cable, generally is equal in diameter to the coaxial cable outer conductor with the diameter of the horn increasing as a function of distance measured from the interface with the coaxial cable toward the circular opening that is formed at the distal end of the horn.

Various attempts have been made in the prior art to smoothly contour the inner surface of a launcher horn to provide efficient coupling of energy between a coaxial cable and a surface wave transmission line. For example, U.S. Pat. No. 2,852,753 discloses a surface wave launcher wherein the inner wall of the launcher horn includes a throat region that extends between the interface of a surface wave transmission line and a coaxial cable and a bell region that extends from the terminus of the throat region to the end or mouth of the horn. In this arrangement, the inner surfaces of the throat and bell regions merge smoothly into one another, with each region being contoured so that the first three derivatives of the mathematical formula that define the inner diameter of the horn in terms of axial distance are each equal to zero when the distance variable is equal to zero (i.e., when the first three derivatives are evaluated at the interface between the coaxial cable and the launcher). The two specific examples of mathematical formulas that are disclosed in the referenced patent include: $D=d\ (\cosh Kx+\cos K\ x)/2$ and $D^4=d^4+K^4 X^4$, where D represents the inner diameter of the horn, d represents the inner diameter of the coaxial cable outer conductor, K is a constant that is selected to provide the desired diameter at the mouth of the horn for a given axial length, and x represents axial distance along the horn as measured from the interface between the horn and coaxial cable.

Although launchers configured in accordance with the referenced patent and similar launchers in which the diameter of the horn increases linearly as a function of distance provide satisfactory operation in some situations, several disadvantages and drawbacks can be encountered. For example, although such prior art surface wave launchers may adequately match the impedance of the surface wave transmission line to the impedance of the coaxial cable over a band of frequencies, the impedance match is not sufficient to provide low-loss transmission in systems that must exhibit a transmission bandwidth on the order of one to four octaves. Further, some transmission systems impose dimensional constraints on the length and diameter of surface wave launchers that cannot be met by prior art arrangements without making unsatisfactory sacrifices in the form of relatively high transmission loss.

SUMMARY OF THE INVENTION

In the present invention, a low-loss, broadband surface wave transmission line launcher is realized by configuring the launcher so that the impedance along the launcher defines a Chebyshev impedance taper. That is, the reflection coefficient, r, of the launcher substantially corresponds to mathematical expression:

$$re^{j\beta 1} = \frac{r_0 \cos \sqrt{(\beta 1)^2 - A^2}}{\cosh A}$$

Where 1 represents the length variable (i.e., distance measured from the interface between the coaxial cable and the launcher in the direction toward the opening of the launcher bell) B is the imaginary part of the signal propagation factor ($\gamma$); A is a parameter that is selected both to accommodate the desired system bandwidth and to minimize the launcher reflection coefficient; and $r_0=\frac{1}{2}\ln(Z_2/Z_1)$, where $Z_1$ is the impedance at the coaxial cable-launcher interface (i.e., the characteristic impedance of the coaxial cable) and $Z_2$ is the impedance at the distal end of the launcher (i.e., at the mouth of the launcher bell).

In effect, the invention forms an impedance transformer that provides optimum impedance matching throughout the entire length of the launcher. The invention is advantageous in that it provides maximum bandwidth for a given launcher length, or, conversely stated, minimum launcher length for a given bandwidth. This characteristic makes the invention especially advantageous in situations in which constraints are imposed on the physical envelope of the launcher (i.e., launcher length and/or the maximum diameter of the launcher).

More specifically, in the practice of the invention, the variables that define launcher impedance as a function of distance along the launcher include the design parameter A, launcher length l, the dielectric constant of the material that separates the launcher horn from the portion of the surface wave transmission line that passes through the launcher, and the inner diameter of the launcher horn. In situations in which the system that employs the launcher imposes a constraint on launcher length and the final diameter of the launcher horn is either a system design constraint that is imposed to limit the size of the launcher or is established to achieve a desired impedance at the interface between the launcher and the open surface wave transmission line, the design parameter A is established to provide a desired passband (i.e., selected to establish the desired low frequency cutoff point). To prevent signal reflection at the interface between the launcher and coaxial cable, the impedance at the launcher-coaxial cable interface is established equal to the characteristic impedance of the coaxial cable. This establishes the ratio of the inner diameterof the horn and the diameter of the center conductor of the launcher (e.g., the diameter of the surface wave transmission line) at the launcher-coaxial cable interface for any given dielectric material that is used within the interior region of the launcher. If the diameter of the inner conductor of the launcher is uniform (e.g., equal to the diameter of the surface wave transmission line), the mathematical relationship required to achieve the Chebyshev tape defines the cross-sectional geometry of the launcher horn for all points between the coaxial cable-launcher interface and the launcher-surface wave transmission line interface (i.e., horn diameter as a function of distance along the horn) in a manner that achieves the lowest possible (optimum) reflection coefficient.

In situations in which the launcher length and/or maximum launcher diameter is not dictated by system design constraints, launcher length and final diameter can be selected to achieve the Chebyshev impedance taper in a manner that results in a desired launcher signal reflection coefficient.

BRIEF DESCRIPTION OF THE DRAWINGS

These and other features and advantages of the invention will be understood more fully after reading the following description taken together with the accompanying drawings in which.

DETAILED DESCRIPTION

Figure 1:
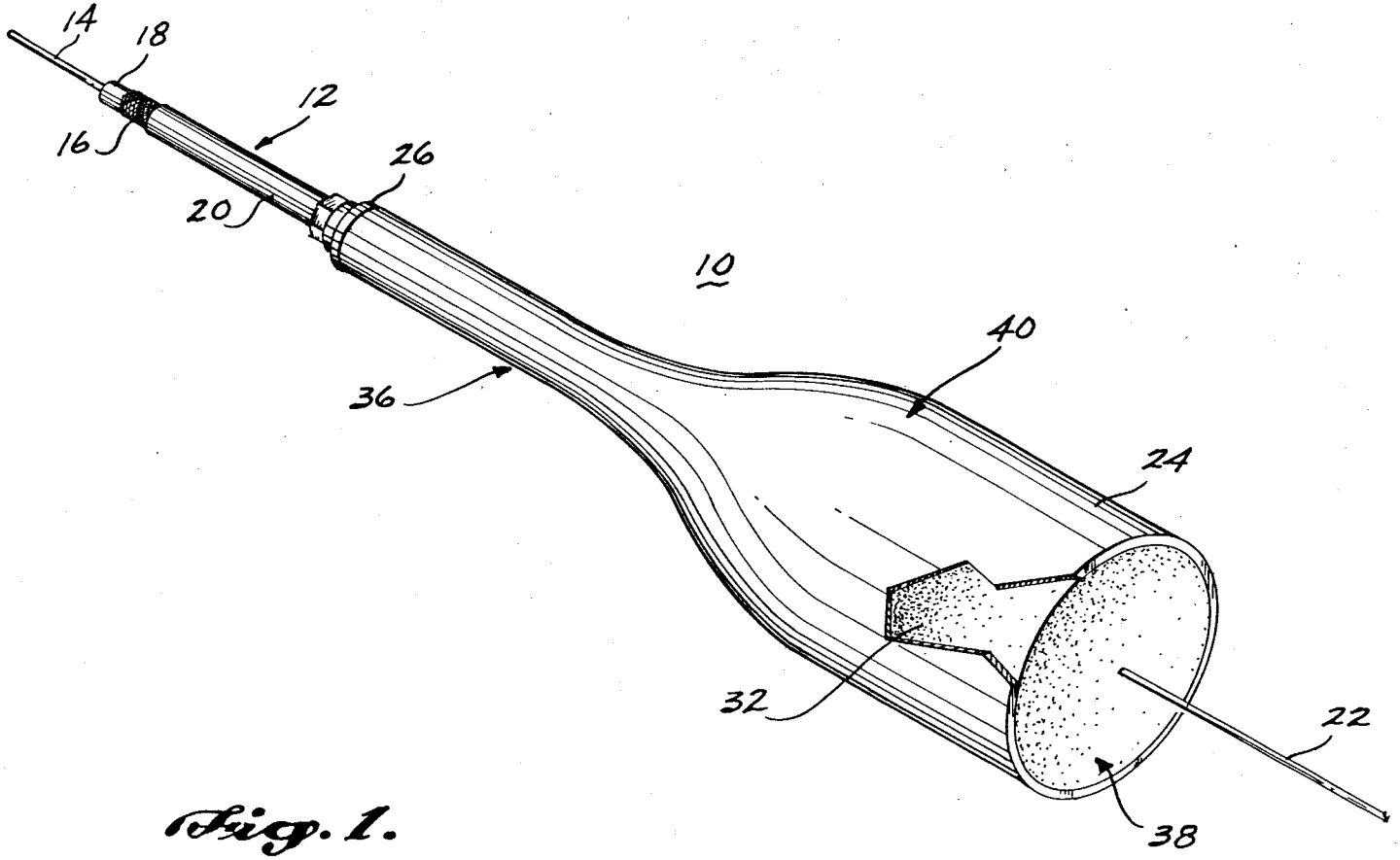
FIG. 1 is a partially cut away, isometric view of a surface wave transmission line launcher that is constructed in accordance with the invention.
Figure 2:
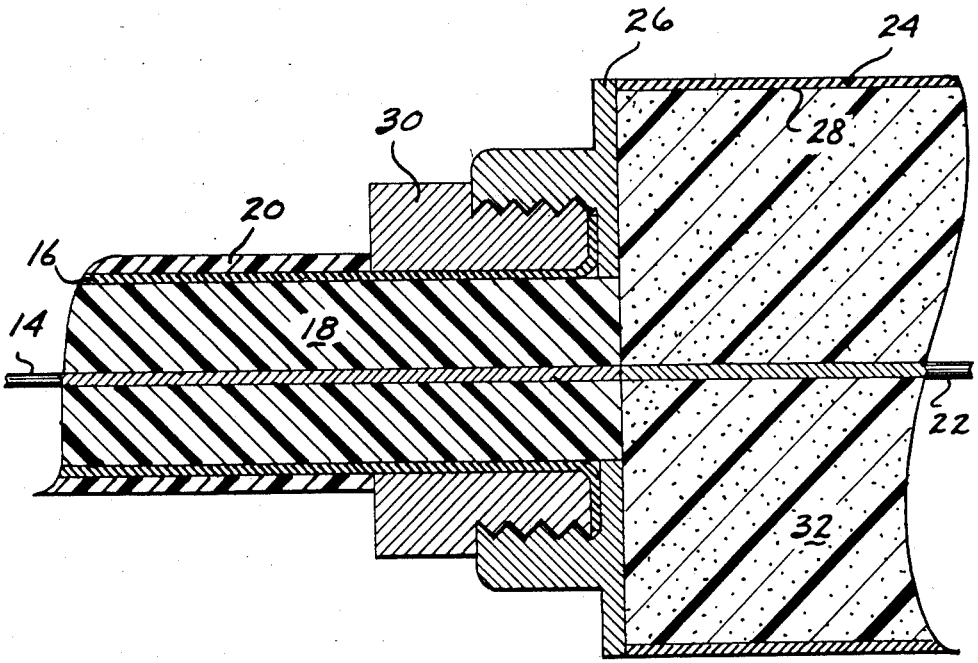
FIG. 2 is an enlarged, cross-sectional view of the coaxial cable-surface wave transmission line launcher region of the arrangement depicted in FIG. 1.

In FIGS. 1 and 2, a surface wave transmission line launcher 10 that is constructed in accordance with the invention is interconnected with a coaxial cable 12. Coaxial cable 12 is of conventional construction and includes a center conductor 14 coaxially contained in a cylindrical outer conductor 16 that generally is formed by a tube of braided wire. The region between center conductor 14 and outer conductor 16 is filled with a dielectric material 18 and an insulating jacket 20 surrounds outer conductor 16.

As is best illustrated in FIG. 2, center conductor 14 of coaxial cable 12 is electrically connected to a surface wave transmission line 22 that extends along the axial centerline of surface wave launcher 10. In the depicted arrangement, the diameter of surface wave transmission line 22 is equal to the diameter of center conductor 14 of coaxial cable 12. As also is shown best by FIG. 2, at the interface between coaxial cable 12 and surface wave transmission launcher 10, outer conductor 16 of coaxial cable 12 is interconnected with a shell-like conductive horn 24 of surface wave transmission line launcher 10. In the depicted arrangement, the diameter of the interconnecting region of the horn 24 exceeds the diameter of the coaxial cable outer conductor 16. In this particular arrangement, the terminal portion of coaxial cable outer conductor 16 is expanded by "combing out" the metal braid (or by other conventional means), with the expanded portion of coaxial cable outer conductor 16 being in abutment with an annular flange 26 that extends radially between coaxial cable outer conductor 16 and the inner wall 28 of launcher horn 24. A nut-like, externally threaded plug 30, which surrounds the end region of coaxial cable jacket 20, is secured in a threaded recess that is formed in the central region of annular flange 26 to urge the terminal portion of coaxial cable outer conductor 16 into electrical contact with launcher horn 24.

In the practice of the invention, the impedance of launcher 10 at its interface with coaxial cable 12 preferably is equal to the characteristic impedance of coaxial cable 12. Thus, it can be recognized that the diameter of launcher horn 24 at its interface with coaxial cable 12 depends upon the dielectric constant of coaxial cable dielectric 18, the relative diameters of surface wave transmission line 22 and coaxial cable center conductor 14 and the dielectric constant of the dielectric material 32 that fills the interior region of the launcher horn 24. Regardless of the exact diameter of launcher 24 at the coaxial cable-launcher interface, it will be recognized that various arrangements can be utilized for electrically connecting coaxial cable outer conductor 16 to launcher horn 24 and for electrically connecting coaxial cable inner conductor 14 to surface wave transmission line 22.

Irrespective of the dimension of launcher horn 24 at its interface with coaxial cable 12 and the arrangement utilized for electrically connecting these elements, the diameter of launcher horn 24 smoothly increases as a function of the axial distance between the inner connection of surface wave transmission line launcher 10 with coaxial cable 12. As is indicated in FIG. 1, the diameter of horn 24 initially increases at a relatively low rate to form what is commonly called a throat region 35. Located between throat region 36 and the circular opening or mouth 38 of horn 24 is a region in which the diameter of horn 24 first increases rather rapidly as a function of axial distance and then smoothly returns to a relatively low rate of increase (commonly called the launcher bell region; identified by numeral 40 in FIG. 1).

It will be recognized by those skilled in the art that surface wave transmission line launchers having launcher horns that provide a smooth transition between a coaxial cable and the bell of the launcher previously have been proposed for use in systems in which a surface wave transmission line is employed and in which apparatus for transmitting and/or receiving RF signals is connected to the surface wave transmission line by coaxial cable. Such surface wave transmission line systems include, for example, systems in which signals supplied to the coaxial cable by a transmitter are coupled to a surface wave transmission line that either passes to a reflector that radiates the electromagnetic energy or passes to a second surface wave transmission line launcher that receives the electromagnetic signals and couples the signals to a transmitter, and/or receiver (or other signal utilization device) via a second coaxial cable. The invention differs from such previously proposed surface wave transmission line launchers primarily in the manner in which horn 24 of surface wave transmission line launcher 10 is contoured to provide optimal impedance matching and minimum launcher length for a given signal bandwidth. Specifically, in accordance with the invention, the diameter of launcher horn 24 is established so that the impedance variation along launcher 10 corresponds to a Chebyshev taper.

More specifically, the reflection coefficient of launcher 10 is given by:

$$r e^{j\beta l} = \frac{r_0 \cos\sqrt{(\beta l)^2 - A^2}}{\cosh A} \tag{1}$$

where,

- a represents the base of the natural (or Napierian) logarithms,
- j denotes the imaginary unit vector,
- l represents axial length along launcher 10,
- $\beta$ is the imaginary part of the propagation constant $\gamma$,
- A is a design parameter that is selected to minimize the reflection coefficient in respect to a signal passband that consists of all frequencies such that $\beta l \geqq A$, and
- $r_0 = \frac{1}{2} \ln Z_1/Z_2$, where $Z_1$ is the impedance of launcher 10 at its interface with coaxial cable 12 and $Z_2$ is the impedance of launcher 10 at mouth 38 of bell region 40.

Inversion of the relationship for the launcher reflection coefficient by means of Fourier transformation theory yields:

$$\ln[Z_0(x/l)] = \tfrac{1}{2}\ln[Z_1 Z_2] + \frac{r_0}{\cosh A}[A^2 G(2x/l, A) + u(x/l + \tfrac{1}{2}) - u(-x/l + \tfrac{1}{2})]; \text{ for } |x/l| \leqq \tfrac{1}{2} \tag{2}$$

where, u is the unit step function and G(2x/l, A) is a function of (2x/l) and A that is defined by:

$$G(2x/l, A) = -G(-2x/l, A) = \tag{3}$$

-continued $$\int_0^{2x/l} \frac{J_1(A\sqrt{1 - Z^2})}{A\sqrt{1 - Z^2}}\, dZ; \text{ for } |2x/l| \leqq 1$$

where, $J_1(A\sqrt{1-Z^2})$ is the first-order modified Bessel function of the first kind for the quantity $A\sqrt{1-Z^2}$.

Figure 3:
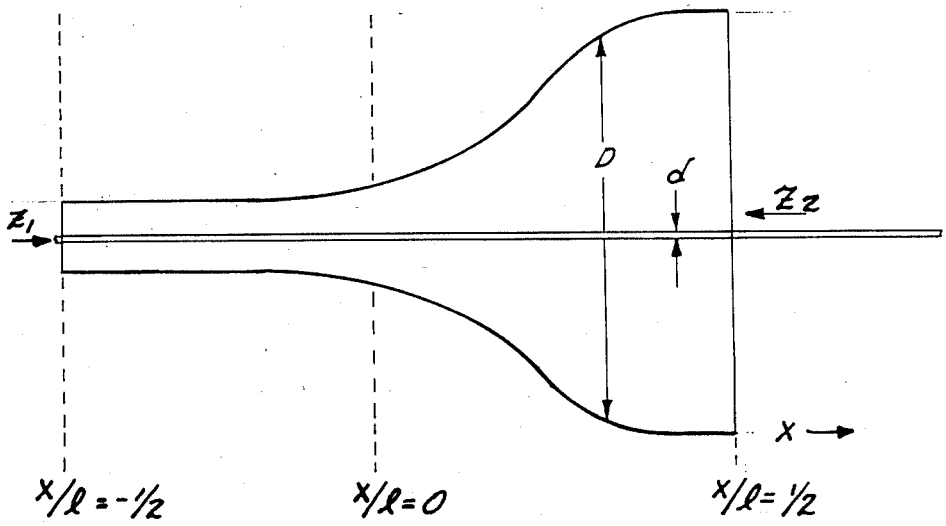
FIG. 3 is a cross-sectional view of the surface wave transmission line launcher of FIG. 1, illustrating the various design parameters that are utilized in the practice of the invention.

The variables in the above equations that are defined by the geometry of launcher 10 are illustrated in FIG. 3. Specifically, as is indicated in FIG. 3, the axial distance variable (x/l) is referenced to launcher 10 so that the interface between coaxial cable 12 and launcher 10 is located at $x/l = -\frac{1}{2}$ and mouth 38 of launcher horn 24 is located at $x/l = \frac{1}{2}$.

Since launcher horn 24 corresponds to a nonuniform or tapered coaxial transmission line, the impedance of launcher horn 24 at any value of (x/l) within the range $(-\frac{1}{2}) \leqq (x/l) \leqq \frac{1}{2}$ is given by the expression:

$$Z = (138/\sqrt{\epsilon_r})\log_{10}(D/d) \tag{4}$$

where, as indicated in FIG. 3, D represents the inside diameter of launcher horn 24 at any given point along the axial dimension of launcher 10, d represents the diameter of surface wave transmission line 22 at that same point, and $\epsilon_r$ represents the dielectric constant of the material 32 that fills the interior region of launcher 10.

Evaluation of Equations 2 through 4 to determine the axial profile of launcher horn 24 (i.e., the diameter D of launcher horn 24 as a function of axial distance along launcher 10) can be readily attained by utilizing a power series expansion of the Bessel function to evaluate G(2x/l); establishing, as a boundary condition $Z_1 = Z_0$, where $Z_0$ represents the characteristic impedance of coaxial cable 12; and establishing additional boundary conditions such as the diameter of launcher horn 24 at mouth 38 and the length of the launcher 1, etc.

With respect to evaluating the function G(2x/l, A), substitution of a power series expansion of the Bessel function yields:

$$G(2x/l, A) = \tfrac{1}{2}\int_0^{2x/l} \sum_{k=0}^{\infty} \frac{(A/2)^{2k}(1 - Z^2)^k}{k!\,(k+1)!}\, dZ; \text{ for } |2x/l| \leqq 1 \tag{5}$$

Term-by-term integration over a range (0, p) where p is a nonzero integer that is selected to provide a desired degree of calculation accuracy can be accomplished by expressing Equation5 as:

$$G(2x/l, A) = \sum_{k=0}^{p} a_k b_k \tag{6}$$

where, $a_0 = 1$; $a_k = A^2/(4k(k+1))a_{k-1}$ and, $b_0 = 2x/l$; $b_k = [2x/l(1 - 4x^2/l^2)^k + 2\,k\,b_{k-1}]/(2\,k+1)$ The above-discussed mathematical expressions can be utilized to determine the dimensional and physical characteristics of a launcher 10 in a variety of design situations and, further, are amenable to computer-implemented calculation. Consider, for example, a situation in which a launcher 10 must meet the following design constraints:

diameter of surface wave transmission line 22=d;
characteristic impedance of coaxial cable 13=$Z_1$;
relative dielectric constant of material 32 that fills launcher 10=$\epsilon_{rl}$;
lower cutoff frequency of the transmission passband=$f_1$;
length of launcher horn 24=L; and,
maximum diameter of launcher horn 24=$D_{max}$.

Figure 4:
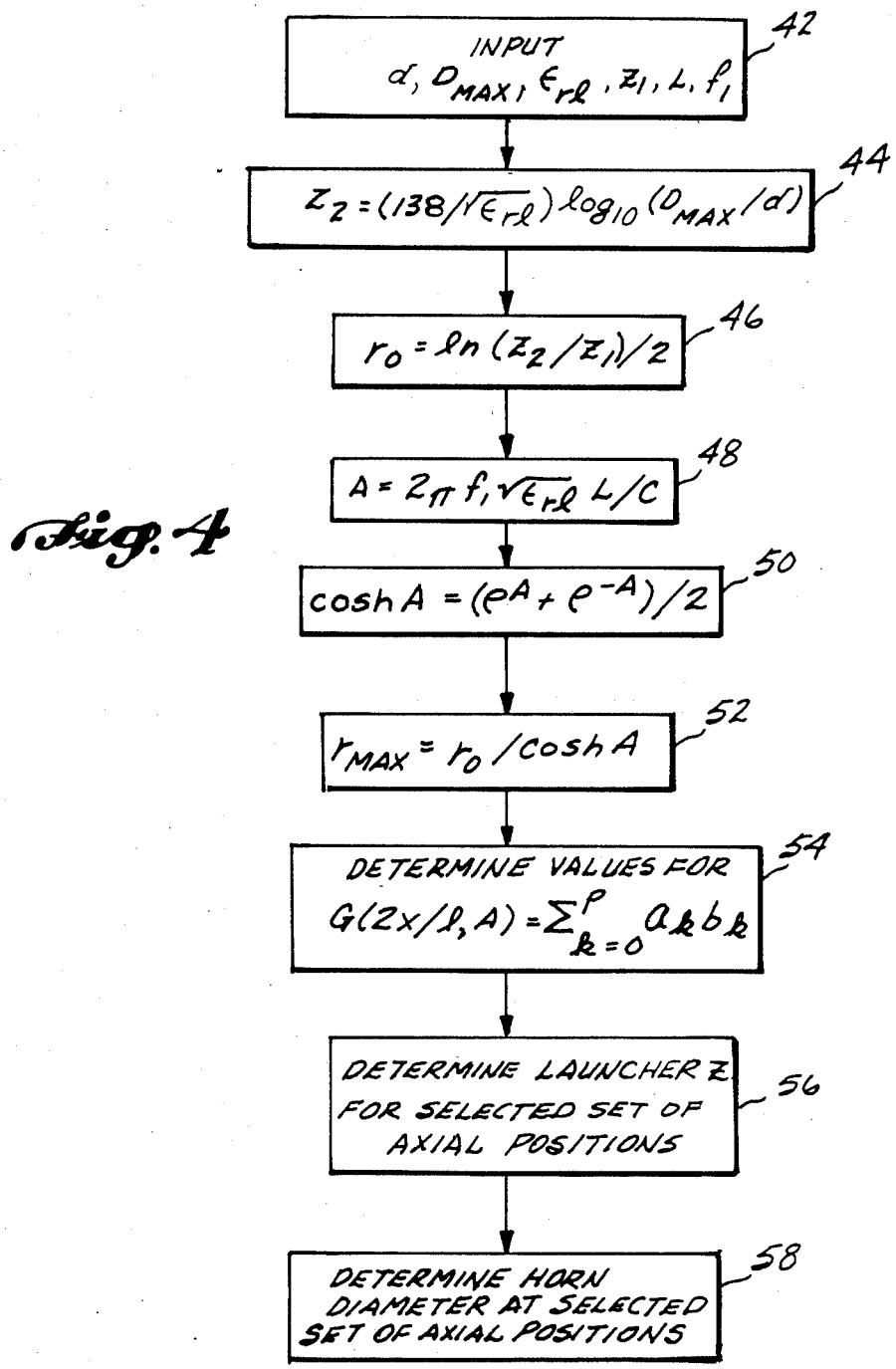
FIGS. 4, 5 and 6 are sequence diagrams (flowcharts) that illustrate a computational process for determining launcher horn diameter as a function of axial distance for an exemplary application of the invention.
Figure 5:
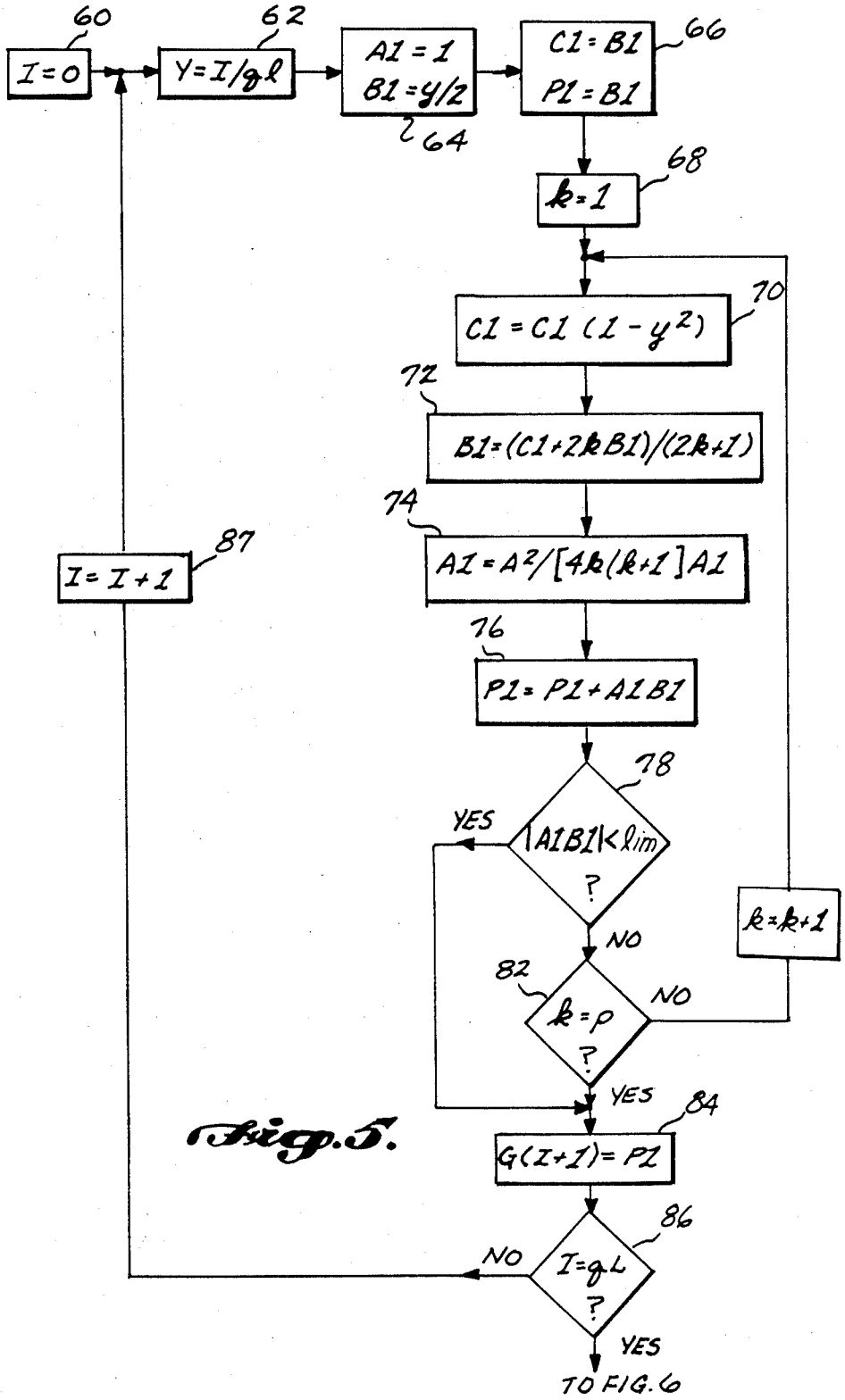
Figure 6:
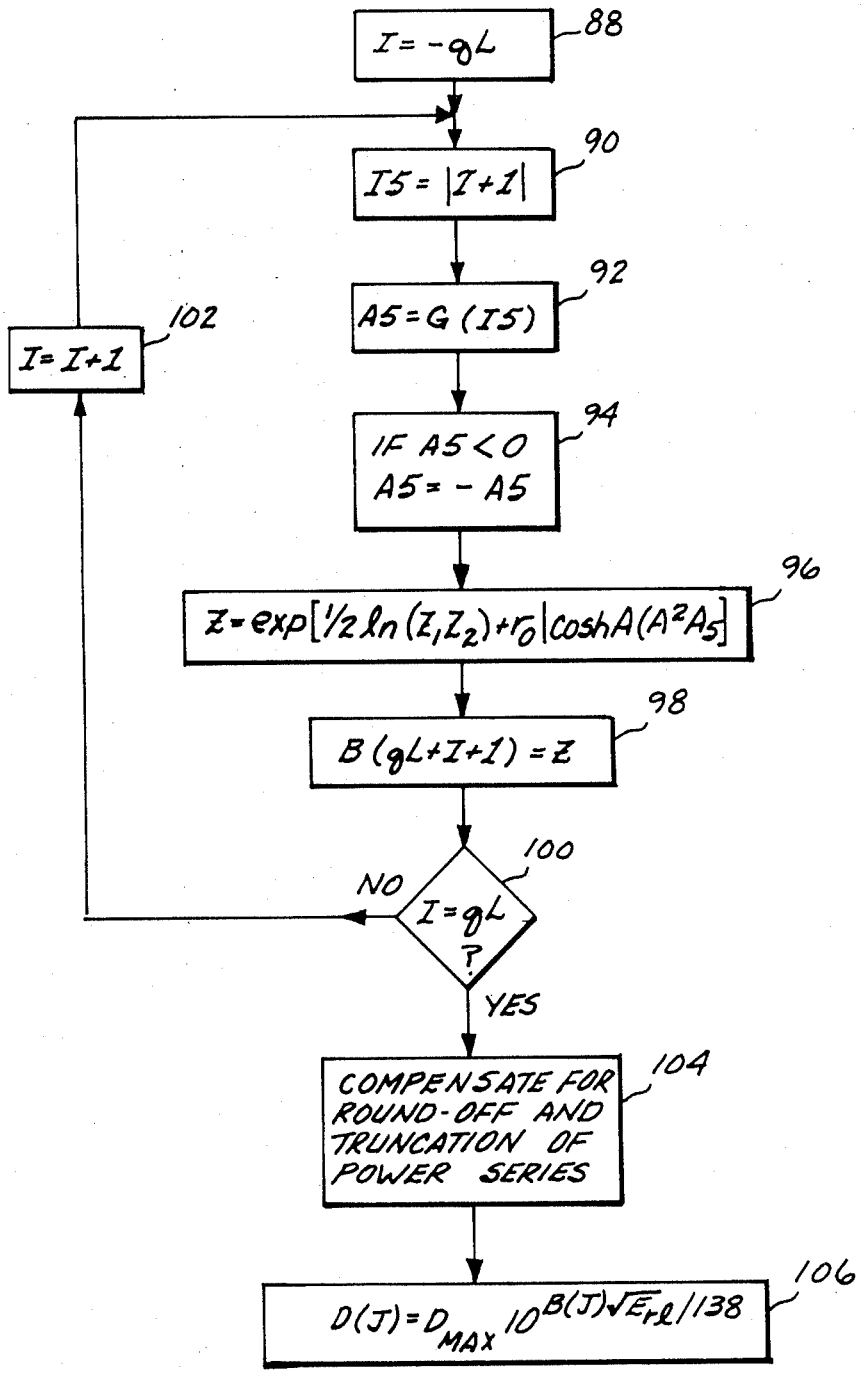

FIGS. 4–6 are flowcharts that illustrate one computer-implemented method for determining the profile of launcher horn 24 (i.e., the diameter of launcher horn 24 at selected axial positions along the launcher horn) under the above set forth design constraints.

Referring first to FIG. 4, the sequence begins with inputting the design parameters d, $Z_1$, $f_1$, $\epsilon_{rl}$, L and $D_{max}$ (indicated at block 42 of FIG. 4). Next, at block 44, the impedance of launcher horn 24 at bell mouth 38 ($Z_2$) is calculated. The value of $r_0$ (Equation 1) is then determined at block 46 for the calculated value of $Z_2$.

As is indicated at block 48, the value of the design parameter A is set equal to its maximum possible value $\beta L$, which is equal to $2\pi f_1\sqrt{\epsilon_{rl}}\,L/c$, where c denotes the velocity of light. Next, the hyperbolic cosine of A is determined (block 50) and the maximum reflection coefficient for a launcher 10 that meets the design constraints is determined (at block 52). It can be noted that at this point of the design procedure, it is possible to evaluate the performance of the design and, if necessary, alter one or more of the input parameters to achieve a lower launcher reflection coefficient.

The calculations required to configure launcher horn 24 to achieve a Chebyshev impedance taper between the ends of the horn (i.e., between $Z_1$ and $Z_2$) begin at block 54. Specifically, as is indicated at block 54 and as shall be described in more detail relative to FIG. 5, Equation 6 is solved to provide values of the parameter G(2x/l, A) at a selected set of axial positions along launcher horn 24. Following this calculation, launcher impedence at each selected axial position is calculated (block 56) and the inner diameter of horn 24 at each selected axial position is determined from the impedance values (block 58). The calculation of the impedance values and the corresponding horn diameters will be described relative to FIG. 6.

Turning to FIG. 5, the depicted sequence for determining values for G(2x/l, A) at a selected set of axial positions beings with setting a computational index, I, equal to 0 (block 60). An axial position variable, Y (which corresponds to the position variable 2x/l in Equation 6), is then set equal to I/qL at block 62. As will be recognized upon understanding the sequence depicted in FIG. 5, the axial position variable Y provides values of G(2x/l, A) for 2x/l=0, 1/qL, 2/qL, 3/qL . . . 1. Since, as previously noted, G(2x/l, A)=−G(−2x/l, A), this procedure in effect provides values of G at predetermined, uniformly spaced axial positions between the launcher-coaxial cable interface and the terminus of the launcher (between x/l=−½ and x/l=½ in FIG. 3); with the interval between the axial positions being ½q. Thus, for example, if 2=5, a value of G is obtained for each 0.1 increment of the unit used to express the length of launcher 10 (i.e., if L is expressed in inches, a value is obtained for axial positions that are 0.1 inches apart from one another). Continuing with the depicted sequence of FIG. 5, two computation variables A1 and B1 are initially established equal to the summation of Equation 6 ($a_0$ and $b_0$), respectively (at block 64). At block 66, a computational variable C1, which is utilized to accumulate the term $(1-(4x^2/l^2))^k$ (Equation 6), and a computational variable P1, which is utilized to accumulate the solution of G(2x/l, A) for each selected axial position, are both set equal to an initial value of B1.

The calculation of G(2x/l, A) at each selected axial position begins at block 68 by setting a computational index k equal to 1 (at block 68). This computational index corresponds to the summation index k of Equation 6. Specifically, with computational index k equal to 1, the calculations indicated at blocks 70, 72, 74 and 76 result in a value of P1 that corresponds to $b_0+a_1b_1$ in the evaluation of Equation 6. To complete the calculation over the required range of 0 to P1, the computational index k is tested at block 80 to determine whether k is equal to p. If k is less than p, k is incremented by 1 (at block 82) and the computational process is repeated beginning with block 70. When k=p, the evaluation of Equation 6 is complete for that particular axial position variable (Y). As is indicated in FIG. 5, by block 78, in the depicted sequence, evaluation of Equation 6 also is considered complete (terminated at a computational value k that is less than p) if the absolute value of the product of A1 and B1 is less than a preselected limit. That is, the process is terminated if the change in the value of G(2x/l, A) that results with that computational index is less than a predetermined value of, for example, $10^{-7}$. This feature of the depicted sequence eliminates unnecessary calculations that are within the range of computational round-off error.

When composition that corresponds to Equation 6 is completed for the current axial position computational index I, the value of P(1) is stored as the (I°1)th element of an array G (block 84), to properly associate the calculated values with the selected axial positions. Next, I is tested to determine whether computation is complete for each of the selected axial positions. Specifically, the value of computational index I is tested at decisional block 86 to determine whether I is equal to qL. If I is less than qL, I is incremented by 1 (at block 87) and the computational sequence is repeated beginning with block 62. When I is equal to qL, the sequence depicted in FIG. 5 is completed and a set of values corresponding to G(2x/l, A) is provided for axial positions 2x/l=1/qL, 2/qL, 2/qL . . . 1. Since, as previously mentioned, G(2x/l, A), it can be recognized that, with respect to FIG. 3, values are available at axial positions ranging between x/l=−½ and x/l=½, with the axial positions being spaced apart by ½ qL. As was previously mentioned and as is indicated in FIG. 5, once the required values of G(2x/l, A) have been determined, the impedance at each of the axial positions is evaluated.

In the calculation sequence depicted in FIG. 6, the impedance at each selected axial position is calculated by utilization of a second computational index I that ranges between −qL and +qL. In this process, the computational index I is initially said equal to −qL at block 88. The proper value of G(2x/l, A) is then accessed by setting a computational variable I5 equal to the absolute value of I+1 (block 90) and establishing the value of a second computational value A5 equal to G(I5). Next, the computational variable A5 is tested to determine whether it is less than zero. If A5 is less than 0, A5 is set equal to −A5.

Next, the impedance for the current value of computational index I (the impedance for one of the selected axial positions) is calculated at block 96 in accordance with the mathematical formula: Z=exp [½ln [Z1/Z2]+$r_0$/cosh A [$A^2$ A5]]. The calculated impedance value is then associated with the proper one of the preselected axial positions by setting the (qL+I+1)th element of an impedance array B, equal to Z.

Next, it is determined whether impedance values have been determined for each of the selected axial positions. Specifically, as is indicated at block 100 of FIG. 6 the computational index I is tested to determine whether it is equal to +qL. If I is less than qL, I is incremented by 1 (block 102) and the computational sequence continues, beginning with block 90. If I is equal to +qL, impedance values have been calculated for each of the selected axial positions along launcher horn 24.

Although the diameter, D, of launcher horn 24 can be determined at each of the selected axial positions by means of the mathematical relationship $D=D_{max}\,10^{B(j)}\sqrt{\epsilon r l}/138$, it often is advantageous to compensate the computed impedance values for round-off error and error that is caused by truncation of the power series expansion to a limit of p (in Equation 6); and in the calculational sequence described relative to FIG. 5). This compensation is generally indicated in FIG. 6 by block 104.

One satisfactory method of compensating the calculated impedance values is given by the mathematical expression:

$$B(J) = [B(J) + \Delta Z_1]\left[1 + \frac{Z_2 - \Delta Z_1 - Z_{2c}}{\Delta Z_1 + Z_{2c}}\right]$$

where,

B(J) represents the "Jth" calculated impedance value, i.e., J ranges between 1 and 2qL+1 with respect to the impedance array that is calculated in accordance with FIG. 6;

$\Delta Z_1$=Zhd 1−B(1), i.e., $\Delta Z_1$ is the difference between $Z_1$ (the coaxial cable characteristic impedance) and the impedance value produced for that same axial position by the sequence of FIG. 6 (at the interface between launcher 10 and coaxial cable 12); and, $Z_{2c}$=B(2qL+1), i.e., $Z_{2c}$ is equal to the calculated impedance value at mouth 38 of launcher horn 24.

Although various compensation techniques can be utilized, it can be noted that the above-defined mathematical formula for compensation of the calculated impedance values causes the impedance at the coaxial cable-launcher interface to be equal to $Z_1$ (the characteristic impedance of the coaxial cable) and also causes the impedance at the mouth of launcher horn 24 to be equal to the design value of $Z_2$. This results in minimum signal reflection at the coaxial cable-launcher 10 interface and further results in attainment of the desired maximum launcher diameter.

In view of the previously set forth description of launcher 10 of FIGS. 1–3 and the exemplary design procedure depicted in FIGS. 4–6, it will be recognized that a launcher horn 24 can be constructed to provide minimum signal reflection in a wide variety of design situations. For example, in situations in which the launcher length and maximum diameter are not constrained by system considerations, one or both of these parameters can be treated as a dependent variable to achieve a desired reflection coefficient.

Further, in some design situations, the dimensions of the launcher 10 (length and/or maximum diameter) or the maximum reflection coefficient of launcher 10 can be controlled by suitable selection of the dielectric constant of the dielectric material 32 that fills launcher 10, the diameter of surface wave transmission line 22 and, in some instances, the type (and, hence, size) of coaxial cable 12. More specifically, in the currently preferred embodiments of the invention, surface wave transmission line 22 is equal in diameter to the center conductor 14 of the coaxial cable 12 that is utilized in the system in which launcher 10 is employed. In these currently preferred embodiments, the dielectric material 32 that fills launcher 10 is an expanded polystyrene foam with a density of approximately 4 lbs/ft$^3$. This material exhibits a relative dielectric constant on the order of 1 and functions only to provide a low-loss support for surface wave transmission line 22. To securely maintain surface wave transmission line 22 within the polystyrene foam, a two-part, foam-in-place polyurethane is utilized. In some situations, it may be advantageous to utilize a surface wave transmission line of a diameter that is not equal to the diameter of the coaxial cable and/or utilize a low-loss dielectric material that exhibits a relative dielectric constant that is greater than 1.

In the practice of the invention, it is also possible to construct launcher horn 24 in various manners. For example, in many situations, launcher horn 24 can be spun or otherwise machined from copper or other suitable material. This technique generally provides the best dimensional control and, hence, the best overall impedance matching (minimum signal reflection). However, in some situations, it may be possible to construct launcher horn 24 by first molding or machining dielectric material 32 to achieve the desired axial profile and then bonding a conductive layer, such as copper or silver foil, to the outer surface of the formed dielectric material 32.

While only particular embodiments have been disclosed, it will be readily apparent to persons skilled in the art that numerous changes and modifications can be made thereto, including the use of equivalent means and devices, without departing from the scope and the spirit of the invention.

What is claimed is:

1. A signal launcher for coupling signals between a coaxial cable and a surface wave transmission line, said coaxial cable including a substantially cylindrical outer conductor and a concentrically contained inner conductor with one end of said inner conductor being electrically connected to a first end of said surface wave transmission line, said signal launcher being of horn-shaped geometry of substantially circular cross section and being formed of electrically conductive material, said launcher having a first end of predetermined diameter that is adapted for electrical connection to said coaxial cable outer conductor at the interface between said coaxial cable and said surface wave transmission line with said surface wave transmission line extending axially through said signal launcher in substantial coincidence with the axial centerline of said signal launcher, the diameter of said launcher increasing with axial distance away from said first end of said launcher to establish a relationship between the impedance of said signal launcher and axial distance along said signal launcher that corresponds to a Chebyshev impedance taper.

2. The signal launcher of claim 1, wherein said signal launcher further includes a dielectric material that surrounds at least a portion of the length of said surface wave transmission line that extends through said signal launcher with said dielectric material extending radially outward to fill at least a portion of said signal launcher and maintain said surface wave transmission line in position along said signal launcher axial centerline.

3. The signal launcher of claim 1, wherein said coaxial cable exhibits a characteristic impedance of $Z_1$ and wherein said diameter of said first end of said signal launcher is established at a value that results in said signal launcher exhibiting an impedance value of $Z_1$ at said first end.

4. The signal launcher of claim 3 wherein said relationship between said impedance of said signal launcher and axial distance along said signal launcher establishes a signal reflection coefficient, r, corresponding to the expression:

$$re^{j\beta l} = \frac{r_0 \cos \sqrt{(\beta l)^2 - A^2}}{\cosh A}$$

where l represents axial length along said launcher as measured from said first end of said signal launcher, $\beta$ is the imaginary part of the signal propagation factor, A is a preselected parameter that establishes the bandwidth of said signal launcher and minimizes said signal reflection coefficient, and $r_0 = \frac{1}{2} \ln(Z_2 Z_1)$, where $Z_2$ is the impedance exhibited by said signal launcher at the distal end thereof.

5. The signal launcher of claim 4 wherein said distal end of said signal launcher exhibits a diameter of $D_{max}$ and the diameter, D, of said signal launcher between said first end and said second end of said launcher substantially corresponds to:

$$D = D_{max} 10^{Z(x)} \sqrt{\epsilon_{rl}} \ /138$$

where $\epsilon_{rl}$ represents the relative dielectric constant of said dielectric material surrounding at least a portion of said surface wave transmission line; and where $$Z_{(x)} = \exp[\tfrac{1}{2}\ln(Z_1/Z_2) + \frac{r_0}{\cosh A}[A^2 G(2x/l, A)]]$$

with $$G(2x/l, A) = \sum_{k=0}^{p} a_k b_k;$$

$a_0 = 1$; $a_k = A^2/[4k\ (k+1]a_{k-1}$ and,
$b_0 = 2x/l$; $b_k = [2x/l(1-4x^2)^k + 2k\ b_{k-1}]/2k+1)$
where x represents the axial position coordinate variable and P is a preselected nonzero integer.

6. The signal launcher of claim 5, where A is substantially equal to:

$$2\pi f_l \sqrt{\epsilon_{rl}} \ L/C$$

where $f_l$ is the low-frequency limit of the band of signal frequencies to be carried by said surface wave transmission line, L is the axial length of said signal launcher, and C represents the velocity of light.

* * * * *

UNITED STATES PATENT AND TRADEMARK OFFICE

CERTIFICATE OF CORRECTION

PATENT NO. : 4,730,172

DATED : March 8, 1988

INVENTOR(S) : Greg A. Benguelt

It is certified that error appears in the above-identified patent and that said Letters Patent is hereby corrected as shown below:

In the Abstract, line 7, "surrunding" should be --surrounding--.
Column 2, line 19, "$X^4$" should be --$x^4$--.
Column 2, line 57, "1" should be --l--.
Column 2, line 60, insert --;-- after "bell)".
Column 3, line 32, "diameterof" should be --diameter of--.
Column 5, line 1, "35" should be --36--.
Column 7, line 2, "13" should be --12--.
Column 7, line 60, "2" should be --q--.
Column 8, line 32, "(I°1)th" should be --(I+1)th--.
Column 9, line 38, "Zhd" should be --$Z_1$--.
Claim 5, line 13, Column 12, line 19, "[4k (k+1]" should be --[4k (k+1)]--.
Claim 5, line 14, Column 12, line 20, "/2k+1)" should be --/(2k+1)--.

Signed and Sealed this

Twentieth Day of September, 1988

*Attest:*

DONALD J. QUIGG

*Attesting Officer*

*Commissioner of Patents and Trademarks*